US008100079B2

(12) United States Patent
Buzzi

(10) Patent No.: US 8,100,079 B2
(45) Date of Patent: Jan. 24, 2012

(54) HIGH PERFORMANCE PLANING HULL PROVIDED WITH A TRIM TAB SYSTEM

(75) Inventor: Fabio Buzzi, Annone Brianza (IT)

(73) Assignee: FB Design S.R.L., Annone Brianza (LC) (IT)

( * ) Notice: Subject to any disclaimer, the term of this patent is extended or adjusted under 35 U.S.C. 154(b) by 37 days.

(21) Appl. No.: 12/417,890

(22) Filed: Apr. 3, 2009

(65) Prior Publication Data

US 2010/0186654 A1 Jul. 29, 2010

(30) Foreign Application Priority Data

Jan. 26, 2009 (IT) ..... M12009A0081

(51) Int. Cl.
*B63B 1/22* (2006.01)

(52) U.S. Cl. ..... 114/285

(58) Field of Classification Search ..... 114/271, 114/275, 284, 285, 286, 288, 290, 291, 56.1, 114/61.2, 61.32; 440/1
See application file for complete search history.

(56) References Cited

U.S. PATENT DOCUMENTS

| | | | | |
|---|---|---|---|---|
| 1,665,149 | A | 4/1928 | Van Wienen | |
| 5,572,944 | A * | 11/1996 | Slikkers et al. | 114/343 |
| 6,773,316 | B1 * | 8/2004 | Keehn, Jr | 440/68 |
| 7,188,581 | B1 * | 3/2007 | Davis et al. | 114/285 |
| 2004/0242091 | A1 | 12/2004 | Okuyama | |
| 2006/0137591 | A1 | 6/2006 | Loui | |

FOREIGN PATENT DOCUMENTS

| | | | |
|---|---|---|---|
| DE | 2924362 | A1 | 1/1991 |
| DE | 3924362 | A1 | 1/1991 |
| FR | 2746763 | A1 | 10/1997 |
| WO | 0030299 | A1 | 8/2000 |
| WO | 0050299 | A1 | 8/2000 |

* cited by examiner

*Primary Examiner* — Daniel Venne
(74) *Attorney, Agent, or Firm* — Hess Patent Law Firm, PC; Robert J. Hess

(57) ABSTRACT

A high performance planing hull, designed in particular for boats with drives of fixed or non-steerable type. The hull comprises an additional volume, which is integrated in the immersed part of the stern of the hull. The additional volume extends substantially in longitudinal direction and is symmetrical with respect to the longitudinal plane of symmetry of the hull.

13 Claims, 7 Drawing Sheets

HIGH PERFORMANCE PLANING HULL PROVIDED WITH A TRIM TAB SYSTEM

BACKGROUND OF THE INVENTION

The present invention relates to a high performance planing hull, in terms of speed and carrying load, provided with a trim tab system. The term "trim tab" is intended as a surface and/or volume positioned at the immersed part of the stern, capable of adjusting the hull trim with respect to the free surface of the water in specific operating conditions.

The prior art comprises planing hulls provided with movable surfaces used to adjust the trim of the boat, known as trim tabs or flaps. When these surfaces are struck by a water flow they generate a hydrodynamic force, which is multiplied by the existing arm between the point in which force is applied and the centre of gravity of the hull to determine a couple that modifies the trim of the boat with respect to the surface of the water.

The couple generated determines rotation of the hull about the pitch axis of the boat.

The surface of the trim tab can be provided with actuating means which allow relative movement thereof with respect to the water flow which strikes it, allowing the user of the boat to "adjust" the amount of trim adjusting couple when there is a variation of speed and conditions of use.

In the case of movable trim tabs, the prior art describes many systems to produce movement of the surface with respect to the water flow which strikes it. In some systems, the actuating means allow simple translation of the movable surface in one direction, while in other more complex systems they allow rotation with respect to an axis.

Prior art hulls are provided with a pair of movable trim tabs installed in lateral position with respect to the propulsion system of the boat, so as not to influence, or be influenced by, the water flow generated.

Various actuating systems, generally of pneumatic or hydraulic type, can be adopted for movement of the surfaces by the user of the boat.

The actuating means of the trim adjusting systems formed by movable surfaces have the considerable drawback of being installed in areas subject to high levels of humidity and salinity, if the hull is used in sea water. These phenomena are particularly hazardous for mechanical parts, which require frequent maintenance.

EP-0794115 describes a planing hull designed to allow housing of the actuating means of the two movable lateral surfaces and prevent contact with water or with atmospheric agents from causing problems of corrosion and making frequent maintenance operations necessary.

The recent increase in the use of high performance planing hulls, in terms of speed and useful carrying load has led to further problems concerning the trim of the boat in some conditions of use and in particular during acceleration before reaching a stable planing trim.

For reasons of dynamic stability, high performance planing hulls are designed so that the centre of gravity is positioned relatively far back with respect to the total length of the hull. In fact, in high performance hulls, the position of the centre of gravity is located at a distance from the stern of 25-40% of the length of the hull.

Although allowing high performance in terms of speed, this characteristic leads to "bow up" trim during acceleration, i.e. the bow of the boat is lifted high above the surface of the water, with consequent visibility problems.

Moreover, in standing start, manoeuvring and/or low speed operating conditions the hydrodynamic force acting on the hull is null or of negligible intensity.

When the navigation speed increases and the hull is planing, conditions of visibility and trim improve considerably, causing "bow down" and allowing navigation in safe conditions.

SUMMARY OF THE INVENTION

The object of the present invention is to overcome the drawbacks of prior art and in particular to adjust the trim of the planing hull in operating conditions in which the acting hydrodynamic thrust has null or negligible intensity, while maintaining a position with the centre of gravity positioned far back to ensure high performance of the hull.

Another object of the present invention is to improve visibility from the bow of the hull obtaining a more "horizontal" trim in acceleration conditions before reaching a stable planing trim.

A further object of the present invention is to reduce the minimum speed at which the hull adopts a planing trim and the time required to reach this, above all in particularly heavy hulls or those designed for fast passenger transport or for military and patrol purposes.

These and other objects are achieved by a high performance planing hull according to claim 1 comprising an additional volume integrated in the immersed part of the stern of the hull.

The additional volume extends substantially longitudinally and is positioned symmetrically with respect to the longitudinal plane of symmetry of the hull.

The lower part of the additional volume comprises at least one surface portion inclined downward with an acute angle with respect to the horizontal. The inclined surface portion can be fixed or can be moved through appropriate actuating means.

Although the hull according to the present invention ensures high performances, as the centre of gravity is positioned farther back, with respect to hulls of the same type it has a more horizontal trim with the bow raised to a lesser extent with respect to the surface of the water even at low speeds.

In fact, the additional volume provided in the planing hull allows adjustment of the trim of the boat during acceleration and at low speeds, thus ensuring greater visibility of the surrounding environment for the user.

The additional volume can be produced at the same time as the hull is moulded and, by means of the downwardly inclined surface, it allows adjustment of the hull trim, avoiding the use of actuating systems and frequent maintenance operations.

Moreover, with the fixed trim tab of the hull according to the present invention it is possible to decrease the minimum speed at which the hull reaches the planing condition as well as to lower the value of this minimum speed necessary.

BRIEF DESCRIPTION OF THE DRAWINGS

Further characteristics and advantages of the present invention will be more evident by the following description, provided by way of example with reference to the appended drawings, wherein:

FIGS. 4B and 4C are side views similar to that of FIG. 4A but referred to a hull according to the present invention, in which FIG. 4B is a side view of the hull with the integrated additional volume and FIG. 4C is a side view of the hull with the integrated additional volume and central movable trim tab, both these embodiments providing a pair of lateral trim tabs;

DETAILED DESCRIPTION OF THE INVENTION

Figure 1:
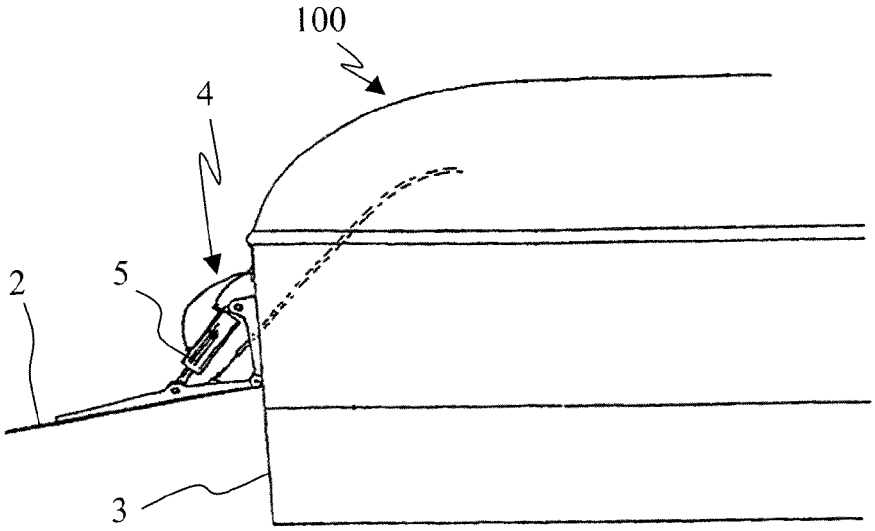
Fig. 1 (PRIOR ART)
FIG. 1 is a schematic view of the stern of a hull provided with movable trim tabs of conventional type.

FIG. 1 shows the stern of a planing hull 100 according to the prior art, provided with a pair of movable trim tabs of conventional type, positioned symmetrically at the sides of the propulsion system.

In order to simplify the view, only one movable trim tab is shown in FIG. 1 and the propulsion system of the boat has been omitted. The movable surface 2 of the trim tab is constrained to the transom 3 of the hull 100. The actuating means 4 for deflection of the movable surface 2 comprise a pneumatic or hydraulic actuator 5 and allow the user of the boat to adjust the trim of the hull 100 with respect to the surface of the water.

In this type of installation the trim tabs, and in particular the corresponding actuating means 4, are fixed to the outside of the hull 100, with consequent problems deriving from exposure of the mechanical parts to water and atmospheric agents.

Figure 2:
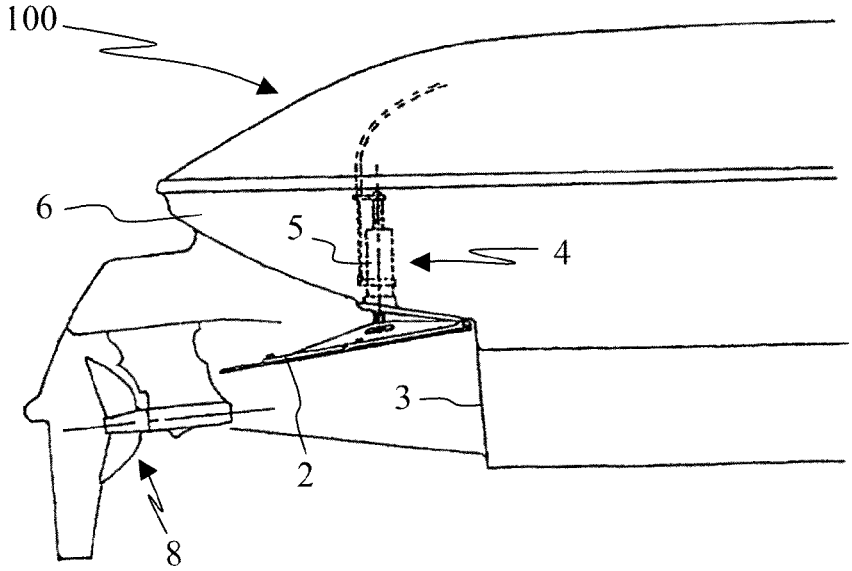
Fig. 2 (PRIOR ART)
FIG. 2 is a schematic view of the stern of a hull according to the prior art, in which the actuating means of the movable trim tabs are housed inside the hull.

To overcome these problems it is known in the art to install the actuating means of the movable trim tabs inside the hull, as shown for example in FIG. 2. Also in this case, for greater clarity, the illustration shows only one of the two trim tabs, which are positioned at the sides of the propulsion system 8 of the boat.

In fact, FIG. 2 shows the stern of a planing hull according to the prior art, i.e. a solution comprising a pair of movable trim tabs 2, controlled by actuating means 4 which are housed inside the hull 100. In more detail, the actuating means 4 and pneumatic or hydraulic actuator 5 are housed inside a projecting volume 6, produced in the end part of the transom 3 of the hull 100. The movable surface 2, constrained to the hull 100 in a know manner, is connected to the free end of the actuator 5 which allows adjustment of the inclination with respect to the water flow.

As stated, this prior art solution allows exposure and direct contact of the actuating means 4 of each trim tab with the water to be avoided.

Figure 3:
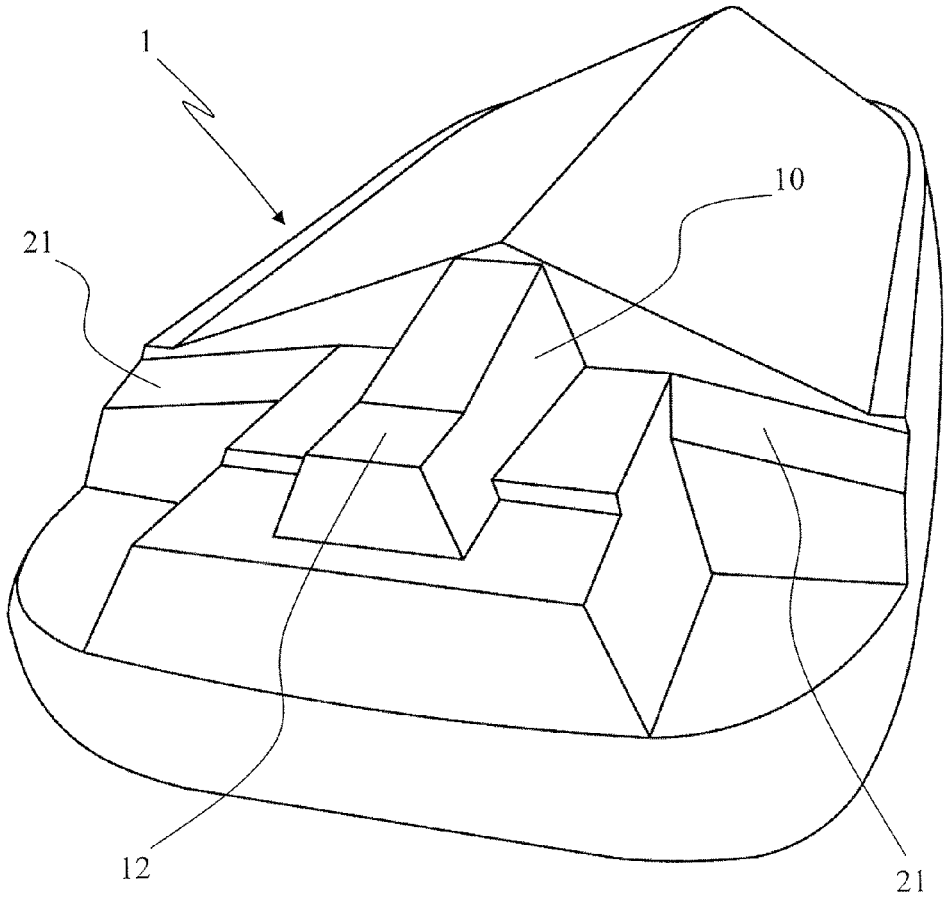
FIG. 3 is a perspective view of an overturned hull with the additional central volume according to the present invention.

FIG. 3 is a perspective view of a planing hull 1 according to the present invention.

The hull 1 is shown in overturned position in order to provide a better view of the immersed part of the hull 1, i.e. the part which in operating conditions is immersed in water.

At the stern of the hull 1, a projecting structure in a form of an additional volume 10 extends substantially in longitudinal direction and is positioned symmetrically with respect to the longitudinal plane of symmetry of the hull.

The additional volume 10 is integrated in the immersed part of the stern of the hull 1 and is provided with at least one downwardly inclined surface 12. This additional volume 10 is designed to touch the surface of the water only at low speed, when hydrodynamic support is required, while it emerges completely from the water at high speed, to reduce the resistance to forward movement.

As stated, the additional volume 10 is preferably produced in one piece with the hull 1, generally through a moulding process at the same time as construction of the hull.

The inclined surface 12 forms the outlet edge of the additional volume 10 and is inclined by an acute angle $\alpha$ with respect to the plane, presumed horizontal, of the water surface. As can be seen in FIGS. 5A-5D, the angle $\alpha$ between the horizontal plane of the water surface and the inclined surface 12 is measured anti-clockwise starting from the horizontal.

The planes 21 and 21, positioned at the sides of the additional volume 10, can be used to install movable trim tabs of known type, for example according to the embodiment shown in FIG. 2. FIG. 3 shows the additional central volume 10 elongated in a direction of elongation between bow and stern and has a widthwise dimension that is transverse to its direction of elongation. The transom in FIG. 3 has a length that extends transverse to the direction of elongation of the additional central volume 10. The widthwise dimension of the additional central volume 10 is shorter than the length of the transom.

During use of the boat, above all during acceleration prior to reaching the planing trim, the additional volume 10, and in particular the downwardly inclined surface 12, allows adjustment of the hull trim, lowering the bow and reaching the planing condition more rapidly.

Figure 4A:
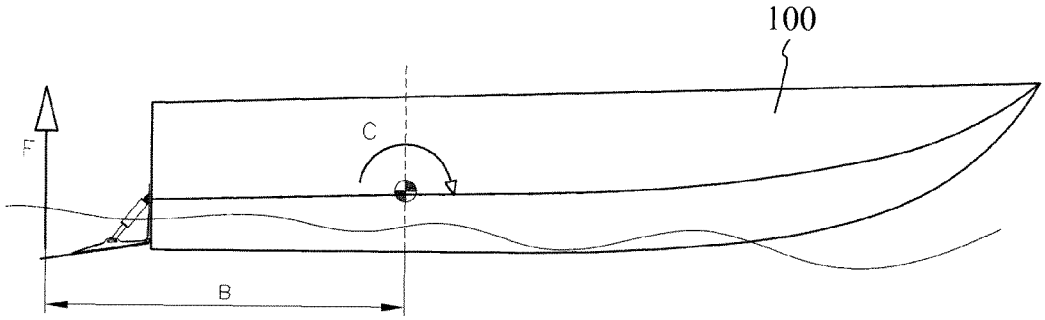
Fig. 4A (PRIOR ART)
FIG. 4A is a simplified side view of a conventional high performance planing hull provided with a pair of trim tabs applied to the transom.

FIG. 4A schematically shows a planing hull 100 according to prior art to illustrate the effect of the trim tabs. These are able to generate a hydrodynamic force F which, multiplied by the arm B, i.e. the distance between the point in which the force F is applied and the centre of gravity of the hull, determines a "pitch down" couple C along the pitch axis.

Figure 4B:
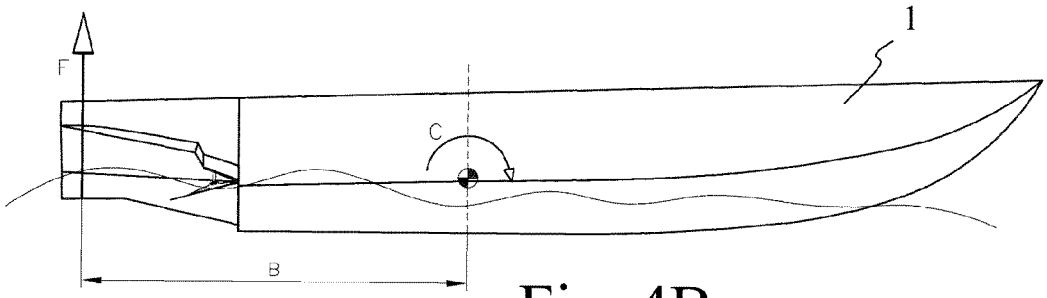

As can be seen in FIG. 4B, which shows a simplified side view of the high performance hull 1 according to the present invention, the additional volume 10 and the inclined surface 12 also generate a hydrodynamic force F, but with an increased arm B with respect to that of the prior art. The increase in couple C allows the trim of the hull 1 to be adjusted more effectively, thus determining the desired "bow down" even with the same force F.

In fact, it must be noted that with the same hydrodynamic force F generated by the additional volume, the larger the arm B is, the greater the couple C will be. It is therefore advisable to design the additional volume in the end part of the stern of the hull 1 in order to increase the arm B. For this reason, the present invention is particularly suitable for planing boats which use integrated fixed, or non-steerable, surface drives, which require the hull to extend beyond the transom to support the axles and the rudders.

Figure 4C:
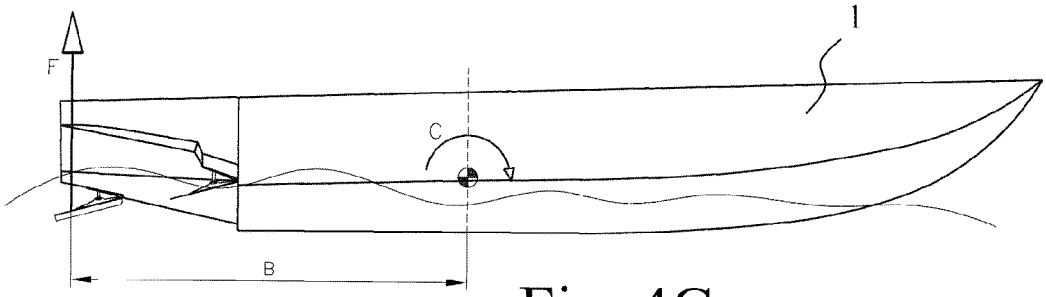

In the embodiment of FIG. 4C, in which the additional volume 10 is provided with a movable surface portion, the arm B can be the same as that of the embodiment of FIG. 4B, but the hydrodynamic force F (and therefore the couple C) acting on the hull 1 can be better adjusted as a function of the particular conditions of navigation.

In an embodiment of the hull according to the present invention (FIG. 5C), a movable trim tab can also be installed behind the additional volume 10 in order to further increase the arm B moving the point in which the hydrodynamic force F is applied as far back as possible with respect to the centre of gravity.

FIGS. 5A-5D show, in a partial side view, four different embodiments of the planing hull 1 according to the present invention provided with the additional volume 10 extending in a substantially longitudinal direction and positioned symmetrically with respect to the longitudinal plane of symmetry of the hull.

In all the embodiments shown (FIGS. 5A-5D), the hull comprises a pair of movable trim tabs installed at the sides of the additional volume 10 with relative actuating means (not shown) housed inside the hull 1.

For greater clarity, FIGS. 5A-5D only show one of the two lateral movable trim tabs 40.

Figure 5A:
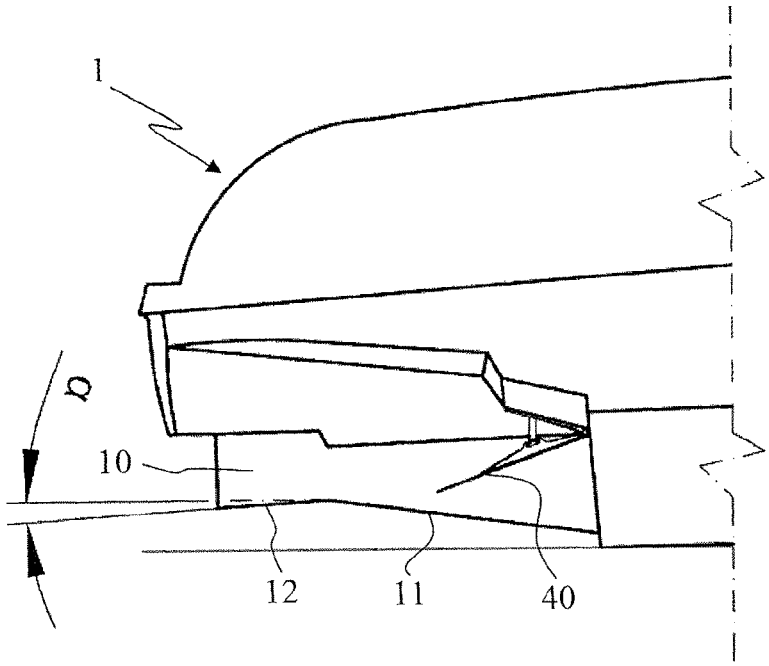
FIGS. 5A-5D show, in partial side view, various embodiments of the high performance planing hull according to the present invention.

In FIG. 5A the planing hull 1 according to the present invention comprises an additional volume 10 provided in the lower part thereof with two mutually inclined consecutive flat surfaces 11 and 12. The surface 12 is inclined downward, by an acute angle α measured with respect to the horizontal.

Figure 5B:
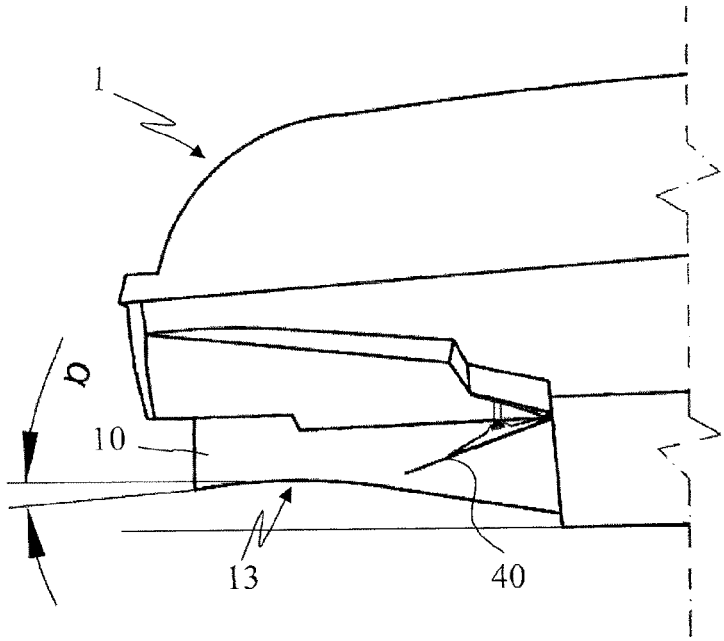

FIG. 5B shows a second embodiment of the planing hull 1, similar to the one described previously in relation to FIG. 5A, from which it differs in that the additional volume 10 comprises a single concave surface 13 having the end part inclined downward by an acute angle α with respect to the horizontal.

Figure 5C:
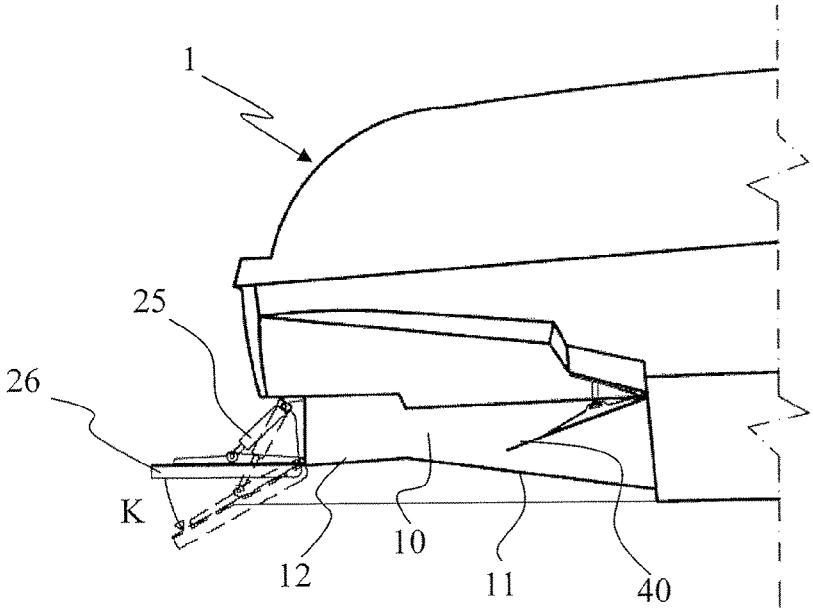

In FIG. 5C the additional volume 10 comprises two mutually inclined consecutive surfaces 11 and 12, as shown in FIG. 5A. Also in this embodiment the surface 12 is inclined downward, by an acute angle α measured with respect to the horizontal. A movable trim tab 25 is installed at the end part of the inclined surface 12 of the additional volume 10 and the actuating means of the surface 26 of the movable trim tab are installed outside the hull 1. Movement of the surface 26 of the trim tab 25 is identified by the arrow K and the dashed lines indicate its possible angular travel.

The presence of a movable trim tab positioned downstream of the additional volume 10, considering the direction of forward movement of the water flow, allows a greater couple C to be generated to adjust the trim with respect to that generated by a hull provided with the additional volume 10 alone. In fact, the movable trim tab positioned behind the additional volume 10 moves the point in which the hydrodynamic force F is applied farther back with respect to the centre of gravity (increasing the arm B), generating a greater couple C with the same hydrodynamic force F.

Moreover, by varying the angle of inclination of the surface 26 of the movable trim tab it is possible to adjust the intensity of the hydrodynamic force F, and therefore of the couple C, as a function of the navigation speed and therefore as a function of the hull trim.

In fact, at low speeds and during acceleration before reaching the planing condition, the movable trim tab is deflected downward by the maximum angle so as to increase the hydrodynamic force F generated by forward movement of the hull.

When the navigation speed increases, the angle of deflection of the movable trim tab decreases progressively until reaching planing condition, in which it is substantially horizontal and parallel with the surface of the water.

However, in the embodiment shown in FIG. 5C, the actuating means of the movable trim tab 25 are subject to the aforesaid problems due to their installation on the outside of the hull where they are subject to the action of external atmospheric agents and water.

Figure 5D:
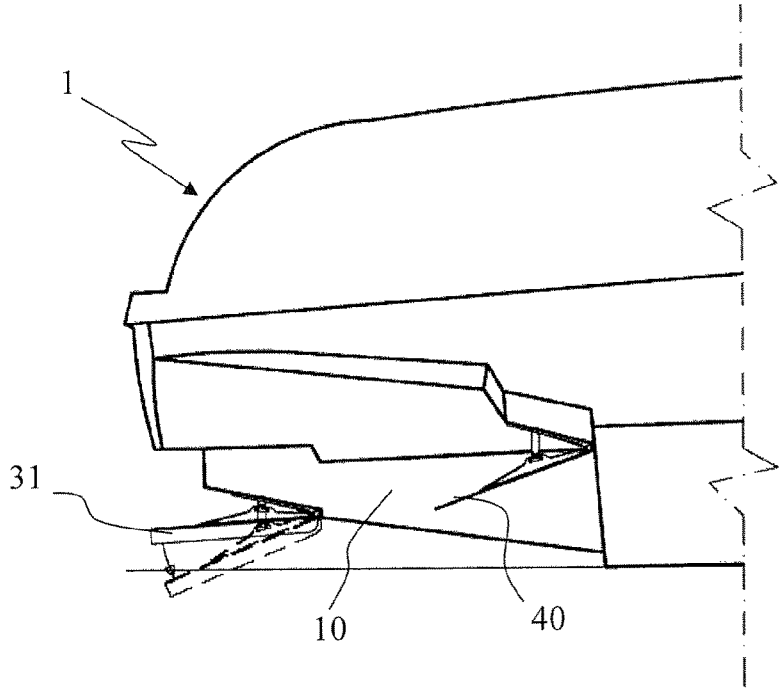

FIG. 5D shows an embodiment of the planing hull 1 in which the downwardly inclined surface of the additional volume 10 is formed by a movable portion 31, controlled by an internal piston.

The actuating means of the movable surface 31 (not shown in FIG. 5D) are housed inside the additional volume 10 of the hull 1. Besides having advantages deriving from the possibility of adjusting the inclination of the movable surface on the basis of the speed of the hull, this embodiment overcomes problems relative to corrosion of the mechanical parts of the actuating means of the movable surface.

The additional volume 10 and the movable trim tab positioned at the end part thereof, according to the embodiment of FIG. 5C, besides adjusting the longitudinal trim of the hull, can also influence the transverse stability of the hull, i.e. the transverse balance about the roll axis.

Figure 6:
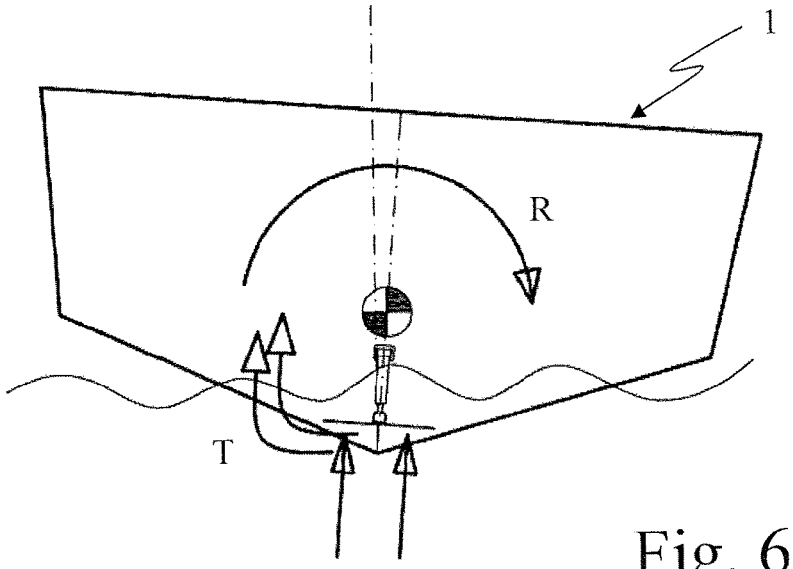
FIG. 6 is a simplified stern view of a high performance planing hull according to the present invention provided with a central movable trim tab of conventional type.

In fact, the stern view of FIG. 6 provides a simplified representation of a planing hull provided with a movable trim tab positioned behind the additional volume (embodiment of FIG. 5C). This representation highlights the fact that an unbalanced transverse component of force T, or a disturbance of the water flow, can cause a rotation R of the hull along the roll axis.

Rotation causes the condition in which the hull is resting on one of the two sides of the planing underbody, which has a "V" section. This position is clearly unacceptable for navigation both in terms of dynamic balance and performance.

Experimental tests have shown that by adjusting the cross section of the movable surface of the trim tab and of the lower part of the additional volume with an upside down U-shape, the flow that strikes the surfaces is channeled, preventing transverse components and disturbances from negatively influencing the transverse balance of the hull. The adjusted cross section of the movable surface of the trim tab and of the lower part of the additional volume with an upside down U-shape constitute a water flow channeling means.

Figure 7:
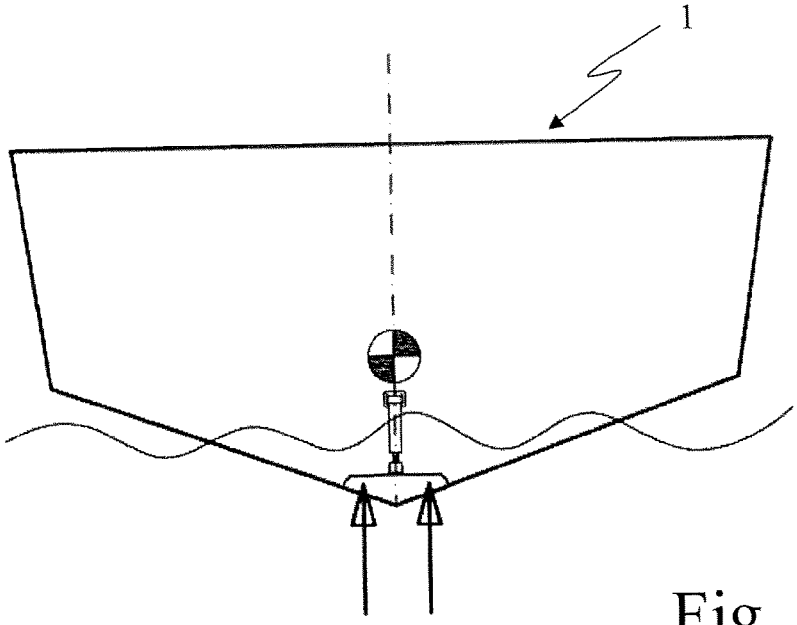
FIG. 7 is a simplified stern view of a high performance planing hull according to the present invention provided with a central movable trim tab with an upside down U-shaped cross section.
Figure 8A:
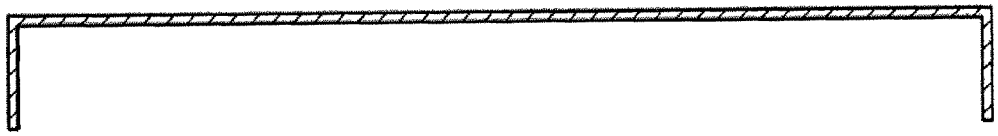
FIGS. 8A-8D show various embodiments of the section of the surface of the trim tab of FIG. 7.
Figure 8B:
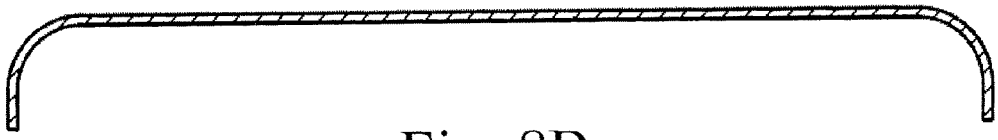
Figure 8C:
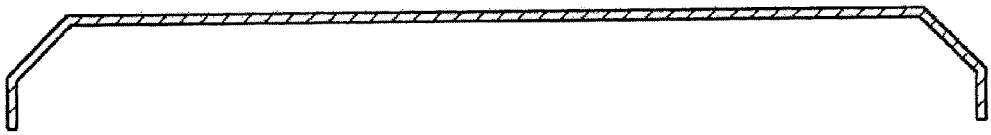
Figure 8D:
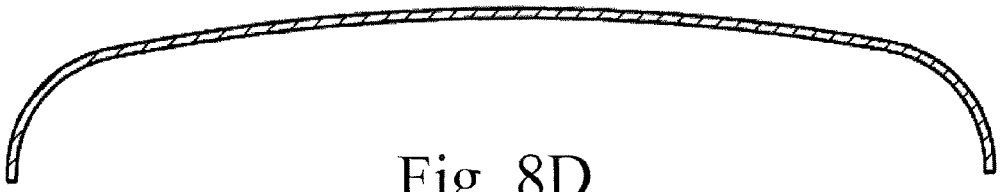

FIG. 7 is a simplified stern view of a planing hull provided with a movable trim tab and an additional volume provided with surfaces with upside down U-shaped cross section. Channelling of the flow allows prevention of lateral discharge of pressure due to transverse force components and/or disturbances of the water flow. The channeling of the flow is done by the water flow channeling means.

FIGS. 8A-8D show in detail some possible embodiments of the cross section of the surfaces, comparable to the upside down U-shape, and therefore able to channel the flow with consequent positive effects on the transverse stability of the hull.

The combination of the movable trim tab integrated in the additional volume with two movable trim tabs positioned at the sides thereof can be electronically controlled through a control unit which acts on the respective actuating systems, setting the position (which will be different for the two types of trim tab) as a function of the variable speed of the boat, for example read by a GPS, and/or of the engine revolutions. Indeed, at least one electronic control unit is provided to make a determination in real time of the position of said inclined movable surface portion 31, which is centrally placed, and of said side movable trim tabs as a function of the boat speed detected by a GPS satellite system and/or of the engine revolutions.

What is claimed is:

1. A planing hull, comprising a hull with drives that are non-steerable, said hull extending longitudinally from bow to stern and bounds a hull volume, the hull including a transom at the stern, the stern having an immersed part, the hull having a projecting structure that projects the hull beyond the transom and is integrated with the immersed part of the stern of said hull, the projecting structure bounding an additional central volume that extends substantially in a longitudinal direction, said additional central volume comprising a lower part with a downwardly inclined surface having an acute angle with respect to horizontal and being movable, said downwardly inclined surface including an actuator housed inside said additional central volume.

2. The planing hull according to claim 1, wherein said downwardly inclined surface has an upside down U-shaped cross section.

3. The planing hull according to claim 1, further comprising two movable trim tabs at sides of said additional central volume.

4. The planing hull according to claim 1, wherein the transom is suited to support axles and rudders.

5. The planing hull according to claim 1, further comprising an internal piston, the downwardly inclined surface being under control by the internal piston.

6. The planing hull according to claim 1, further comprising water flow channeling means including surfaces of the movable trim tab and the additional central volume having an upside down U-shape cross section.

7. The planing hull according to claim 1, wherein the transom Is elongated to define a length the additional central volume defining a widthwise dimension that is shorter than the length of the transom, both the length of the transom and the widthwise dimension of the additional central volume extending transverse to a direction of elongation of the additional central voume.

8. A planing hull, comprising a hull with drives that are non-steerable, said hull extending longitudinally from bow to stern and bounds a hull volume, the hull including a transom at the stern, the stern having an immersed part, the hull having a projecting structure that projects the hull beyond the transom and is integrated with the immersed part of the stern of said hull, the projecting structure bounding an additional central volume that extends substantially in a longitudinal direction, said additional central volume comprising a lower part with a downwardly inclined surface having an acute angle with respect to horizontal and being movable and centrally placed; and at least one electronic control unit making a determination in real time of a position of said downwardly inclined surface and of positions of side movable trim tabs, the determination being made as a function of boat speed as detected by a GPS satellite system and/or of the engine revolutions.

9. A planing hull, comprising a hull with drives that are non-steerable, said hull extending longitudinally from bow to stern and bounds a hull volume, the hull including a transom at the stern, the stern having an immersed part, the hull having a projecting structure that projects the hull beyond the transom and is integrated with the immersed part of the stern of said hull, the projecting structure bounding an additional central volume that extends substantially in a longitudinal direction, said additional central volume comprising a lower part with a downwardly inclined surface having an acute angle with respect to horizontal and being movable, wherein in consideration of a direction of forward movement of a flow of water with the immersed part of the stern immersed in the water, further comprising a movable trim tab positioned downstream of the additional central volume, the hull with the movable trim tab and the additional central volume generating a pitch down couple suited to adjust trim of the hull, the pitch down couple being greater than a pitch down couple generated by the hull with the additional central volume alone.

10. The planing hull according to claim 9, wherein the movable trim tab being downstream of the additional central volume constitutes an arrangement in which the movable trim tab is behind the additional central volume, causing a point in which a hydrodynamic force is applied to be further back with respect to a center of gravity to generate the pitch down couple that is greater than that generated by the hull with the additional central volume alone yet with a same hydrodynamic force.

11. The planing hull according to claim 10, wherein varying an angle of inclination of a surface of the movable trim tab enables adjustment of an intensity of the hydrodynamic force and therefore of the pitch down couple as a function of navigation speed and therefore of the trim of the hull.

12. The planing hull according to claim 10, wherein the movable trim tab deflects downward so as to increase the hydrodynamic force generated by forward movement of the hull at speeds lower than that for reaching a planing condition.

13. The planing hull according to claim 12, wherein, as the navigation speed increases, the movable trim tab deflects at an angle of deflection that decreases progressively until reading the planing condition in which the movable trim tab is substantially horizontal and parallel with a surface of the water.

* * * * *